US011613934B2

(12) United States Patent
Pinho Dos Reis et al.

(10) Patent No.: US 11,613,934 B2
(45) Date of Patent: Mar. 28, 2023

(54) SYSTEM FOR COUPLING BETWEEN A BEND STIFFENER AND A BELL MOUTH COMPRISING A PLURALITY OF LOCKING MECHANISMS

(71) Applicant: PETROLEO BRASILEIRO S.A.—PETROBRAS, Rio de Janiero (BR)

(72) Inventors: Bruno Pinho Dos Reis, Rio de Janeiro (BR); Ricardo Wagner Capllonch, Teresopolis (BR); Flavio Barroso De Mello, Rio de Janeiro (BR); Claudio Violante Ferreira, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 15/734,646

(22) PCT Filed: Jun. 5, 2019

(86) PCT No.: PCT/BR2019/050207

§ 371 (c)(1),
(2) Date: Jun. 21, 2021

(87) PCT Pub. No.: WO2019/232605

PCT Pub. Date: Dec. 12, 2019

(65) Prior Publication Data

US 2021/0348449 A1 Nov. 11, 2021

(30) Foreign Application Priority Data

Jun. 6, 2018 (BR) ..... 102018011452-2

(51) Int. Cl.
*E21B 17/01* (2006.01)
*E21B 17/08* (2006.01)

(52) U.S. Cl.
CPC ..... *E21B 17/017* (2013.01); *E21B 17/085* (2013.01)

(58) Field of Classification Search
CPC ..... E21B 17/017; E21B 17/085
See application file for complete search history.

(56) References Cited

U.S. PATENT DOCUMENTS 3,729,941 A * 5/1973 Rochelle ..... E21B 43/0135 405/169
5,437,518 A * 8/1995 Maloberti ..... E21B 43/0107 405/169

(Continued)

FOREIGN PATENT DOCUMENTS

EP 3241976 A1 11/2017
EP 3473801 A1 * 4/2019 ..... E21B 17/017

(Continued)

OTHER PUBLICATIONS

PCT International Search Report of PCT Application No. PCT/BR2019/050207 dated Sep. 30, 2019.

*Primary Examiner* — Matthew R Buck
(74) *Attorney, Agent, or Firm* — Raphael Bellum PLLC

(57) ABSTRACT

The present invention provides a system for coupling between a bend stiffener (1) and a bell month (2) comprising a plurality of locking mechanisms (3), wherein each locking mechanism (3) is secured externally to the bell mouth (2) and comprises a movable lug (30) positioned such as to slope downwards, in which the lug (30) accesses the interior of the bell mouth (2) and is actuated by an elastic element (34) designed to exert pressure on the lug (30) in the direction of the interior of the bell mouth (2).

10 Claims, 6 Drawing Sheets

(56) References Cited

U.S. PATENT DOCUMENTS

| | | | | | |
|---|---|---|---|---|---|
| 5,947,642 | A * | 9/1999 | Teixeira | F16L 37/127 | 405/195.1 |
| 7,387,469 | B2 * | 6/2008 | Duggan | F16L 1/20 | 405/211 |
| 8,016,520 | B2 | 9/2011 | Dybvik | | |
| 8,573,305 | B2 * | 11/2013 | Reddy | E21B 17/017 | 166/343 |
| 8,931,807 | B2 | 1/2015 | Taylor | | |
| 8,939,214 | B2 | 1/2015 | Litherland | | |
| 9,482,061 | B2 | 11/2016 | Latimer | | |

FOREIGN PATENT DOCUMENTS

| | | | | |
|---|---|---|---|---|
| GB | 2019520 A | * | 10/1979 | E21B 43/0107 |
| GB | 2203508 A | | 10/1998 | |

* cited by examiner

SYSTEM FOR COUPLING BETWEEN A BEND STIFFENER AND A BELL MOUTH COMPRISING A PLURALITY OF LOCKING MECHANISMS

FIELD OF THE INVENTION

The present invention is in relation to pipeline and riser technologies. More specifically, the present invention is in relation to systems and methods for connecting bend stiffeners to bell mouths.

BACKGROUND OF THE INVENTION

In systems that connect a bend stiffener and a bell mouth, it is widely recognized that one of the major causes of unproductive time on Pipe Laying Support Vessels (PLSV) are those due to environmental conditions that prevent shallow dives from being performed during riser pull-in operations, as this operation (shallow dive) is necessary to ensure that the connection of the bend stiffener to the bell mouth has been properly performed.

In order to decrease unproductive time on PLSVs, it was found that the state of the art lacks a docking system between a bend stiffener and a bell mouth that is able to withstand the force of connecting the reduced-curve bend stiffener, increasing the reliability of this operation and eliminating the need for shallow dives in parallel with the PLSV.

Currently, performing shallow dives is essential in all stages of pull-in operations in I-Tube type supports (Bell Mouth). Therefore, prior to arrival of a PLSV and consequent transfer of the riser to the Stationary Production Unit (SPU), a shallow dive is necessary to verify the operation of the bell mouth locking mechanism in order to first clean its interior area, in order to remove any encrustations that might interfere with coupling the riser's bend stiffener to it, and if necessary, using a gauge to verify the internal size of the bell mouth.

During the step of transferring the riser from the PLSV riser to the SPU, during the shallow dive pulleys are installed, connecting the bend stiffener to the hull of the SPU, to prevent the bend stiffener from falling in the event there is a premature rupture of the fusible pull-in cables caused by an overload due to excessive interference in the coupling of the riser to the bell mouth.

In addition, the shallow dive inspects the entire coupling process of the bend stiffener to the bell mouth, verifying the angle of the riser's overhead line, while remaining alert to any interferences that might occur.

After conclusion of the pull-in operation, the shallow dive inspects the integrity of the pipe, places the dogs from the bell mouth in the locked position, and removes the pulleys that would prevent the bend stiffener from falling.

In accordance with what has been presented up to this point, it is clear that the shallow dive is currently involved in all stages of the pull-in operation, in which the most critical moment is that of coupling the bend stiffener to the bell mouth, as it acts in parallel with the PLSV.

The state of the art has a wide array of docking systems between a bend stiffener and a bell mouth, as shown in the following documents.

Document U.S. Pat. No. 4,808,034A shows a means for securing a marine riser to a floating structure using sliding guide rings that are attached to the riser, which is then installed on a receiver on the lower part of the floating structure and connected to a conduit system on the floating structure.

During installation of the riser, the guide ring is inserted into a receiving guide ring positioned below the floating structure. After it is docked, the riser may be pulled.

Document US20090020061A1, in turn, shows a connector for linking an anchor in the form of a female end placed on a floating means and a male end formed on the end of a recoverable cord from a bend stiffener. According to US20090020061A1, the male end contains a spindle end with a helmet connected to a pulling mechanism on one end and a cord on the other end. The male end comprises a body in the form of a sleeve that is attached to the body of the spindle by shearing elements.

The bend stiffener is then secured directly to the body formed by the sleeve and it is designed to abut up against and "park" alongside the bend stiffener, inside the female end, while the cord is designed to be pulled up through the female end towards a vessel.

Document BRPI1106877A2 shows a buffering sleeve and anchoring method. More specifically, that document refers to an accessory device that comprises an anchoring sleeve, which is coupled to a bend limiter that can be used in the anchoring operation of a collection line in order to eliminate the need for fusible cables and safety straps, and to dispense with a dive team, ensuring the operation is carried out regardless of ocean conditions.

Document U.S. Pat. No. 8,573,305B2 reveals an automatic release system for a riser that includes a guide funnel assembly (bell mouth) that receives a helmet that is coupled to the riser. A pulling head is coupled to a pulling mechanism. One or more spring-loaded dogs are assembled on the outside of the helmet. The dogs are moved radially inside and outside through one or more openings in the shaft aligned with the dogs, and they are fitted into a groove in the pulling head when moved radially through the openings.

One or more release mechanisms are mounted on the outside of the helmet and aligned with the dogs. In a first position, the release mechanisms prevent the dogs from disengaging from the orifice in the pulling head. In a second position, the release mechanisms allow the dogs to disengage from the orifice in the pulling head.

Document U.S. Pat. No. 5,947,642A reveals an apparatus and a method intended to ensure that flexible undersea pipes coming from the ocean floor can be connected at any point located above sea level to a structure on the surface.

According to this document, two main components are used: a bell mouth and a connecting device, which is connected to the flexible line that is to be connected to the structure.

Specifically, U.S. Pat. No. 5,947,642A reveals an automatic locking system of the stiffener to the bell mouth that comprises a pivoting lock activated by an elastic element. According to the described configuration, the stiffener comprises an upper guide, in which the lower part of the guide comprises a frustum, with a diameter that is larger than the upper part of the guide. Thus, during passage of the lower portion of the guide through the locking element, it is dislocated radially. Right after passage, the locking element is pressed back into its initial position, locking the stiffener to the bell mouth. In light of the documents presented, it is clear that the state of the art still lacks a docking system between a bend stiffener and a bell mouth that is highly reliable, which would eliminate the need to conduct a shallow dive operation to ensure attachment.

As will be better detailed below, this invention seeks to resolve the problems in the state of the art described above in a practical and efficient manner.

SUMMARY OF THE INVENTION

The purpose of the present invention is to provide a docking system between a bend stiffener and a bell mouth that comprises reliable automatic locking so that the step of performing a shallow dive in this operation may be dispensed with.

In order to attain the objective described above, this invention provides a coupling system between a bend stiffener and a bell mouth comprising a plurality of locking mechanisms in which each locking mechanism is secured externally to the bell mouth, and it comprises a movable lug positioned so that it is sloping downward, in which the lug accesses the interior of the bell mouth and it is activated by an elastic element adapted to exert pressure on the lug towards the inside of the bell mouth.

BRIEF DESCRIPTION OF THE FIGURES

The detailed description presented below references the annexed figures and their respective reference numbers.

DETAILED DESCRIPTION OF THE INVENTION

First, it is noted that the following description will begin with a preferred implementation of the invention. As will become evident to any technician in the matter, however, the invention is not limited to that specific implementation.

This invention is intended to be used in a system to couple a bend stiffener to a bell mouth, eliminating the need for a shallow dive at the critical moment of the operation (parallel operation with the PLSV). It is noted that diving operations in a pre-operating pull-in stage (cleaning, camera installation, and verification of the operation of the mechanisms) must still be repeated with use of this invention, since this is not the most costly phase of the operation.

To that end, the invention developed [sic] a concept of locking the bend stiffener much more efficiently than those known in the state of the art, which made it possible to reduce the charges associated with the process of connecting the bend stiffener to the bell mouth and reducing diving activities.

Figure 1:
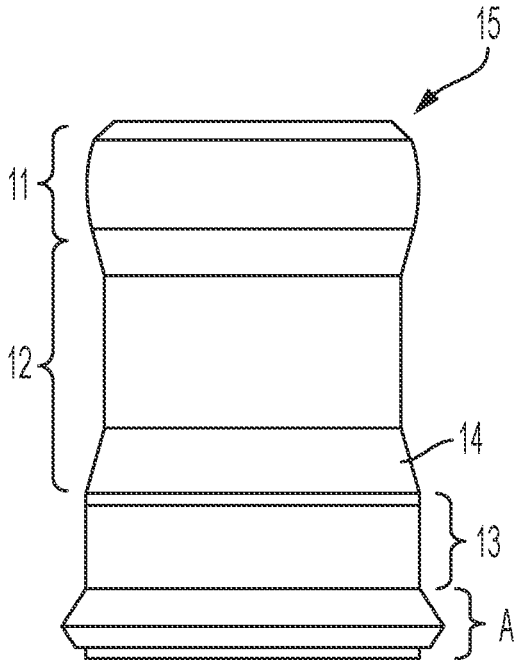
FIG. 1 shows a frontal view of a bend stiffener in accordance with an optional configuration of this invention.

FIG. 1 shows a view of a bend stiffener 1 in accordance with an optional configuration of this invention. In this configuration, the shape of the helmet 15 of the bend stiffener 1 is tubular, with the upper portion 11 shaped like a dome.

Thus, considering a probable range of misalignments in the angle of the riser's overhead line, the initial contact between the helmet 15 and the inside of the bell mouth 2 will be gentler. In other words, the geometry of the initial contact prevents the sharp corners of the helmet 15 of the bend stiffener 1 from contact inside the bell mouth 2, which could cause significant interference.

Figure 1A:
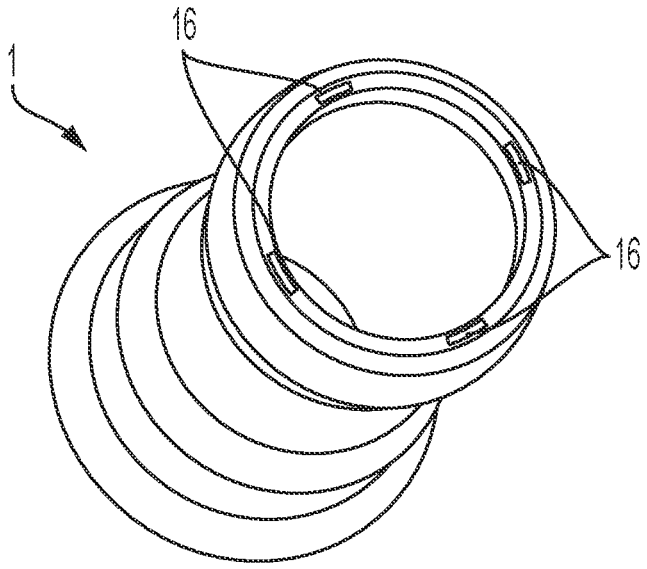
FIG. 1*a* illustrates a top-down view of the bend stiffener in FIG. 1.

FIG. 1*a* shows a top-down view of the bend stiffener 1 in FIG. 1.

Optionally, the helmet 15 of the bend stiffener 1 comprises support elements 16 of fusible cables 4 on its upper surface that are used in the pull-in stage. It is highlighted that in the helmets 15 of stiffeners 1 in the state of the art, there is no definition of these points, with frequent sizing of the eyebolts, which could be potential areas for interference in the pull-in process of the bend stiffener 1.

Also optionally, the bend stiffener 1 may comprise an intermediate region 12 with a diameter that is smaller when compared with its upper 11 and lower 13 portions. Therefore, the coupling between the bend stiffener 1 and the bell mouth 2 will be gentler, reducing the coupling-resistant forces. In this configuration, the transition between the upper 11 and lower 13 portions with the intermediate 12 portion may contain a conical transition section 14 (sloped walls), in which the lower conical portion 14 is adapted to perform the final alignment of the bend stiffener 1 during coupling with the bell mouth 2. That characteristic will become more evident with the following description.

Figure 2:
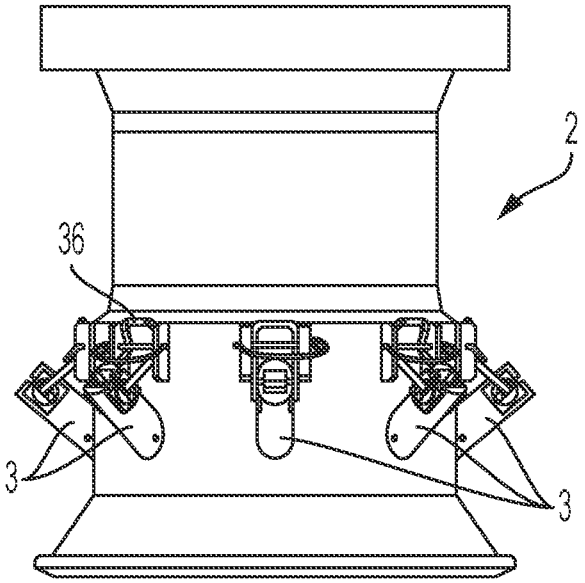
FIG. 2 shows a view of a bell mouth configuration in accordance with an optional configuration of this invention.
Figure 3:
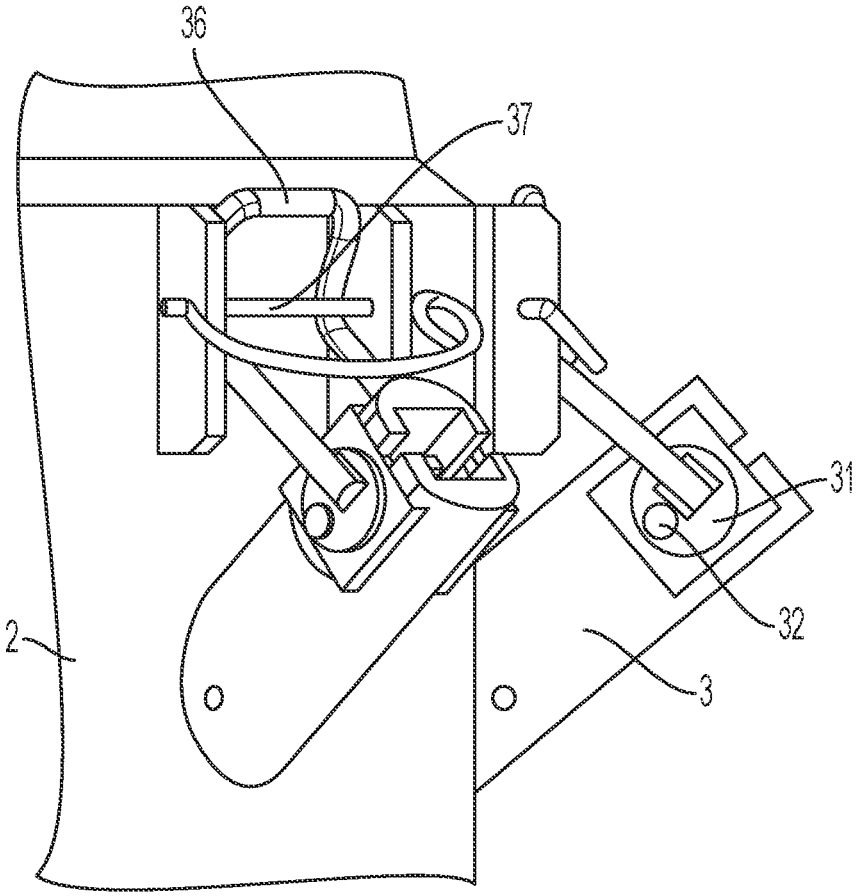
FIG. 3 shows a close-up view of the locking system of the bend stiffener shown in FIG. 2.
Figure 4:
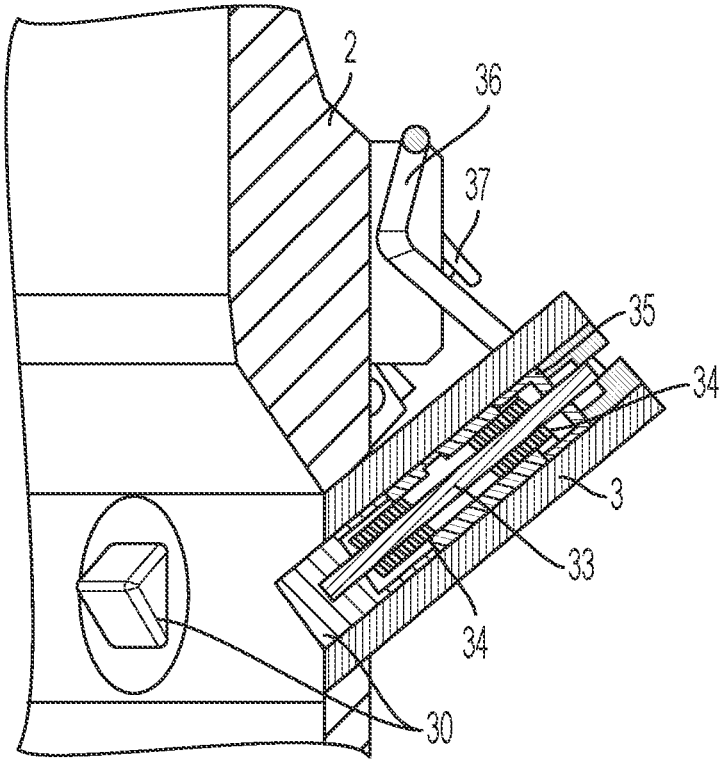
FIG. 4 shows a cross-cut view of the configuration illustrated in FIG. 3.

FIG. 2 shows a view of a bell mouth configuration 2 in accordance with an optional configuration of this invention. FIG. 3 shows a close-up view of the locking system of the bend stiffener 1 illustrated in FIG. 2. FIG. 4 shows a cross-cut view of the configuration illustrated in FIG. 3.

As can be seen, the bell mouth 2 of this invention comprises a plurality of locking mechanisms 3 adapted to lock the bend stiffener 1 when it is in its final position.

The locking mechanism 3 of the bend stiffener 1 to the bell mouth 2 comprises lugs 30, which, along with the entire locking mechanism 3, are confined to the inside of a lug carrier 3. During the pull-in operation, the lugs 30 are retracted to allow the passage of the bend stiffener 1 and it is automatically returned to the extended position by elastic elements 34 that have been placed in a reaction block.

To do this, the locking mechanism 3 is positioned facing downward, so that the elastic elements 34 exert pressure to move the lugs 30 downward at a slant.

The significant advantage of the bell mouth 2 of this invention resides in the fact that it is not necessary to perform a shallow dive to lock the lugs 30 after attaching the bend stiffener 1, which is done by the force of the elastic elements 34 that press the lug 30 inside the bell mouth 2.

Figure 5:
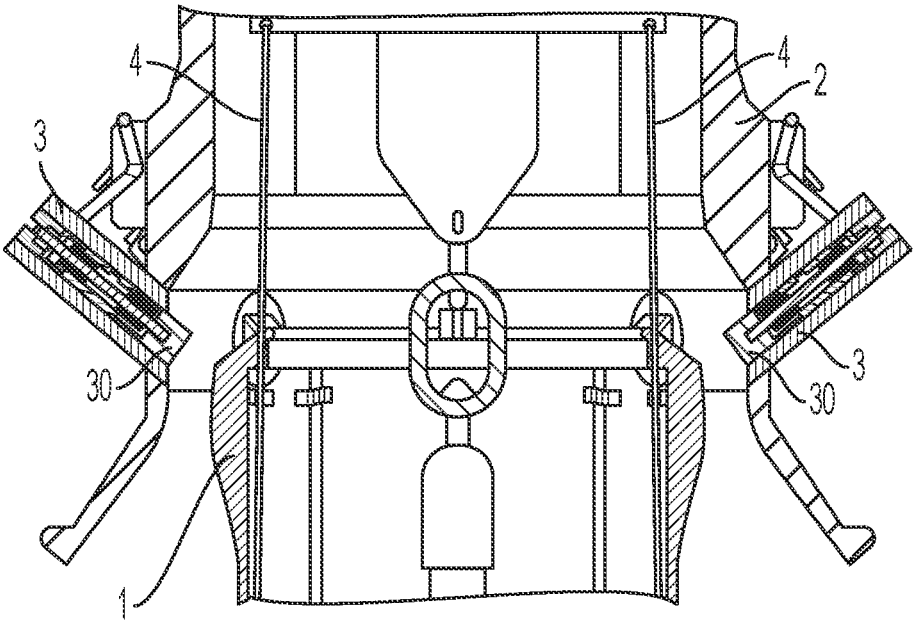
FIG. 5 shows a view of the initial stage of the pull-in operation in which a bend stiffener is introduced into a bell mouth, in accordance with an optional configuration of this invention.

FIG. 5 shows a view of the initial stage of the pull-in operation in which a bend stiffener 1 is introduced into a bell mouth 2, in accordance with an optional configuration of this invention.

In this case the weight of the riser is completely transferred from the PLSV to the FPSO and the bend stiffener 1 is about to enter the bell mouth 2.

In that configuration, the bend stiffener 1 begins the process of entering into the bell mouth 2. Note that the domed shape of the upper portion 11 of the helmet 15 facilitates passage of the bend stiffener 1.

Figure 6:
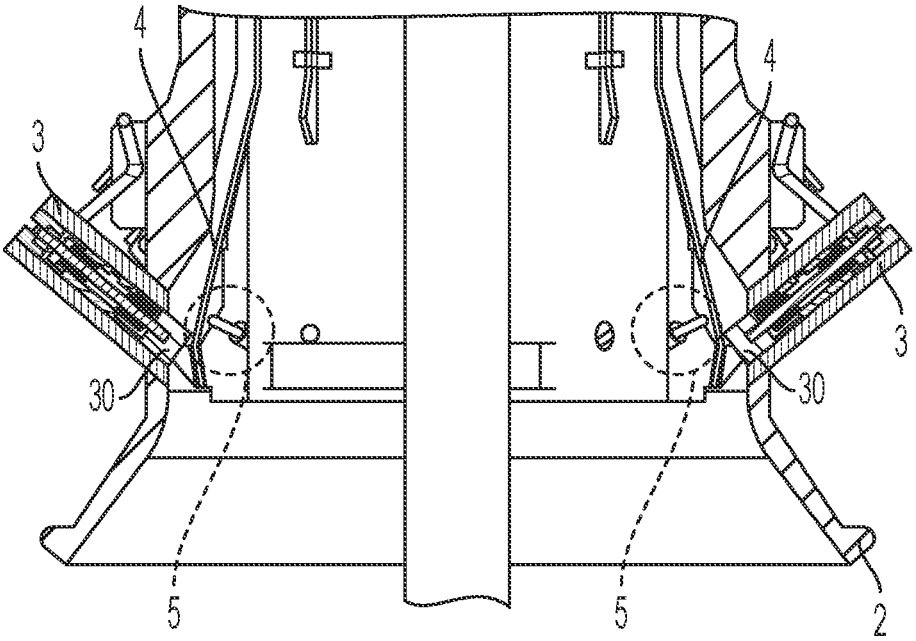
FIG. 6 shows a situation in which the bend stiffener is almost completely connected to the bell mouth, in accordance with the configuration in FIG. 5.

FIG. 6 shows a situation in which the bend stiffener 1 is almost completely connected to the bell mouth 2, in accordance with the configuration in FIG. 5.

Also at this point there is no significant interference between the bell mouth 2 and the bend stiffener 1, due to its optimized geometry. At this point, the lower portion (A), comprising an elastomer cone, of the bend stiffener 1 begins to touch the lugs 30 of the locking mechanism 3, initiating their retraction.

When the bend stiffener 1 is moved up, the lugs 30 are pressed even further inside until total passage of the bend stiffener 1 through the lugs 30.

Figure 7:
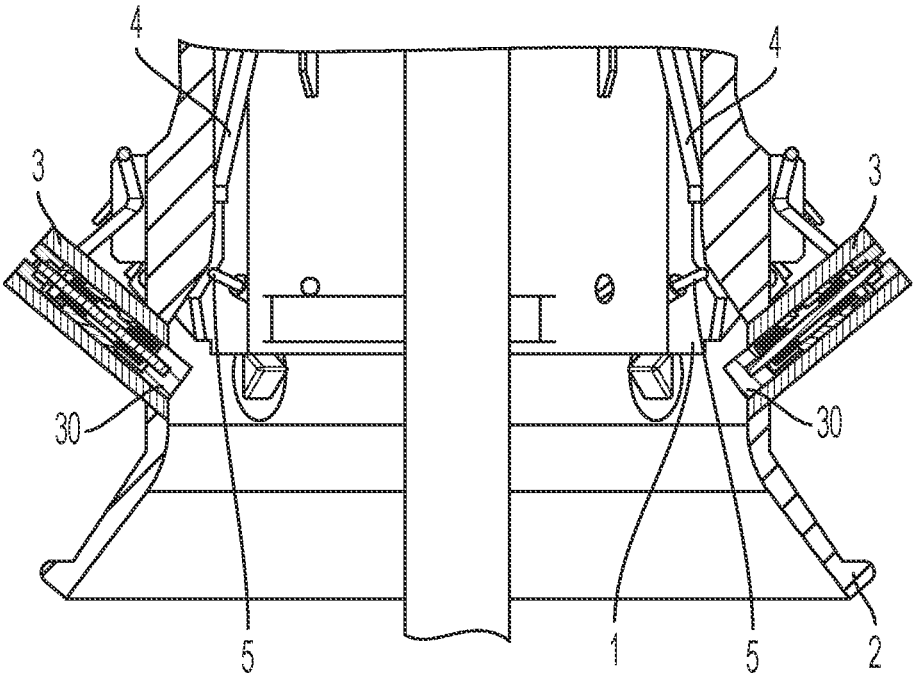
FIG. 7 shows the bend stiffener in its highest position inside the bell mouth, according to an optional configuration of this invention.

FIG. 7 shows a view of a bend stiffener 1 in its final position in accordance with an optional configuration of this invention.

Note that at this point the bend stiffener 1 reaches its physical limit inside the bell mouth 2 and each fusible cable 4 is pressed against a shearing element 5.

Therefore, the bend stiffener 1 comprises a plurality of shearing elements 5, each one associated with a fusible cable 4, in which each shearing element 5 is adapted to press the fusible cable 4 against the internal wall of the bell mouth 2, when the bend stiffener 1 is in its highest position inside the bell mouth 2.

Preferably the shearing element 5 comprises a shearing surface in contact with the fusible cable 4 when the bend stiffener 1 is in its final attached position.

Thus, the shearing element 5 causes damage to the fusible cable 4 at the end of the pull-in operation.

This concept allows the choice of synthetic fusible cable 4 with high breakage tension, mitigating the risk of it breaking prematurely, prior to the stage shown in FIG. 7. Thus it is possible to replace the steel fusible cables 4 in the state of the art with synthetic fusible cables 4, as now proposed.

There are numerous advantages to using this technology as an alternative to the steel fusible cable 4 for pull-in, such as, for example, its high malleability, facilitating its installation, and the possibility of reducing its mechanical resistance by the operation of some type of cutting tool, which may help in the final break of the cable.

Additionally, as it is a much softer material in relation to steel cables, any residue caused by cable breakage that falls inside the trumpet of the bend stiffener 1 does not present a risk regarding damage to the outside layer of the flexible riser. Throughout the entire pull-in operation, however, the operation of this concept is quite similar to use of fusible cables made of steel.

Figure 8:
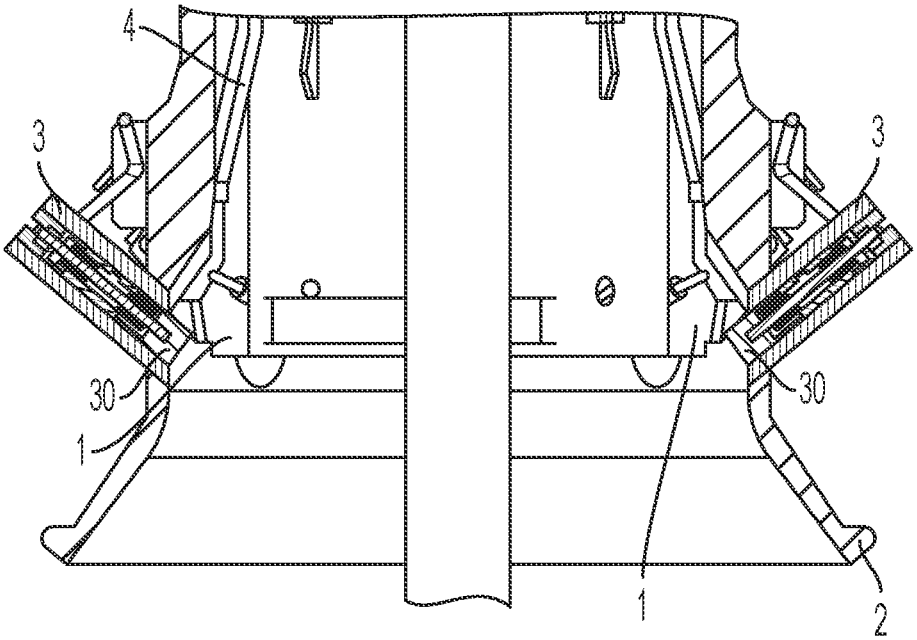
FIG. 8 shows the system of the present invention in which the bend stiffener is in its seated position.

FIG. 8 shows the system of the present invention in which the bend stiffener 1 is in its seated position. Note that after breakage of the fusible cables 4, the bend stiffener 1 descends due to gravity, in order to be supported by the lugs 30, thus ending the pull-in operation.

Thus it can be seen that there is a huge advantage of the invention, consisting of the fact that the locking mechanism 3 is positioned angled downward. Therefore, during entry of the bend stiffener 1 in the pull-in operation, the lug 30 is pushed, pressing the elastic elements 34, which allows the passage of the stiffener 1.

However, at the end of the process, when the fusible cables 4 break, the lugs 30 return to their final position and the weight of the stiffener 1 exerts a cutting force on the lug 30, not allowing it to be retracted.

Optionally, the invention also foresees that the locking mechanism 3 comprises a handle 36 that may be activated to move the lug 30 to the retracted or extended position. The handle 36 may be activated by a human operator (diver) or by an ROV, which choice can be made on a case by case basis.

In the configuration described in the previous paragraph, a clamp 37 may also be used to lock the handle 36, preventing its involuntary movement.

The following is a description of how the pull-out operation occurs in accordance with this invention.

Figure 9:
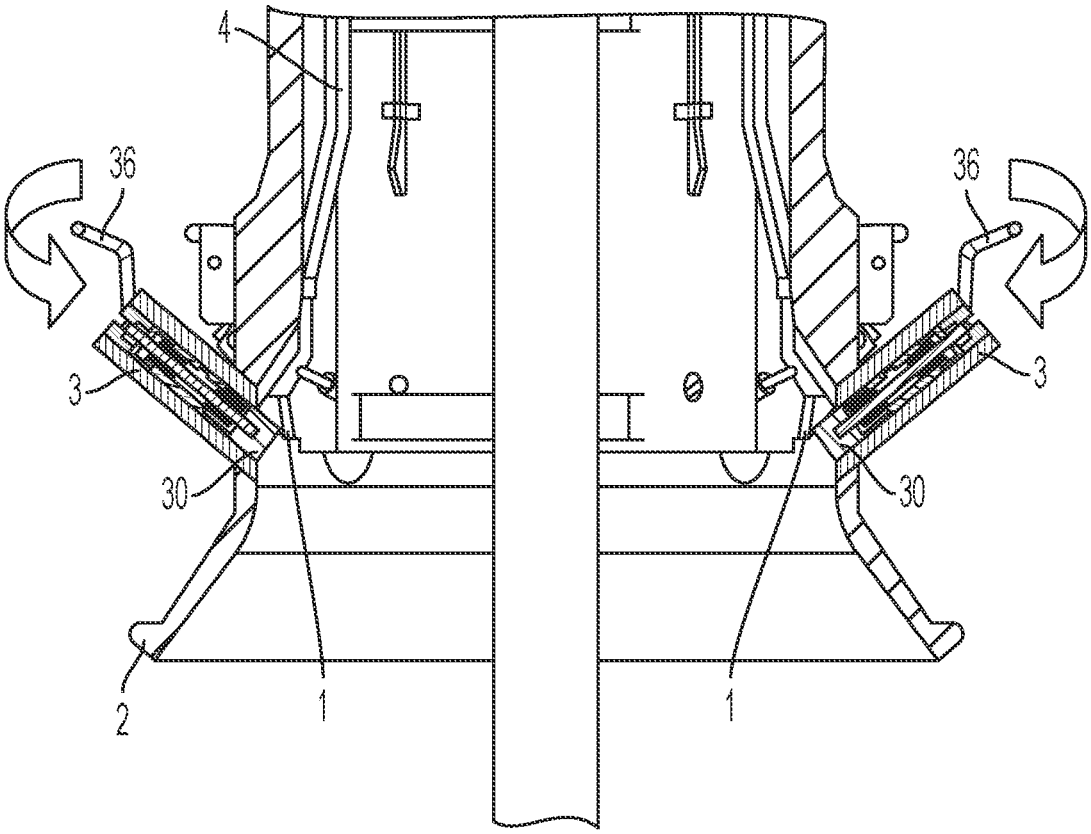
FIG. 9 shows the system of the present invention at the start of the pull-out operation.

FIG. 9 shows the system of the present invention at the start of the pull-out operation. For the pull-out the clamps 37 are removed, allowing the handle 36 to be moved. It is important to highlight that, optionally, the elastic elements 34 are not compressed in this stage. The locking mechanism 3 may be designed so that all parts (lug 30, elastic elements 34, shaft 33, and the reaction block 35) are moved together when the handle 36 is activated.

Figure 10:
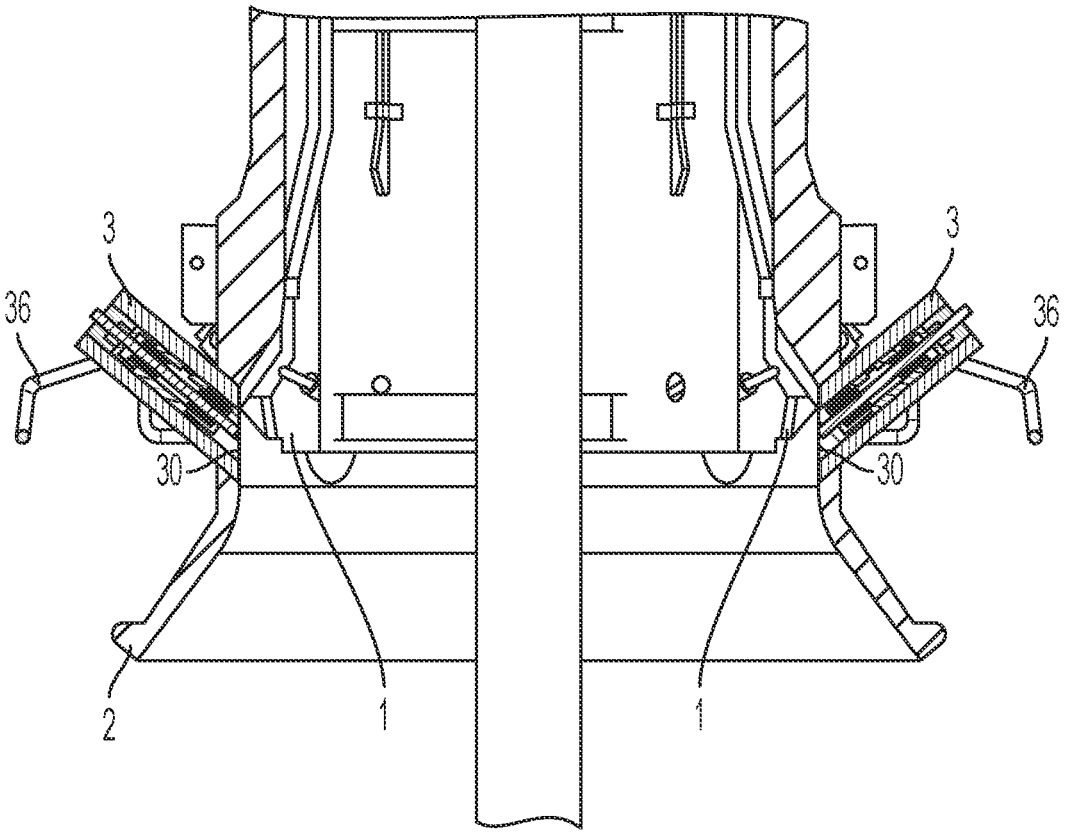
FIG. 10 shows the system of the present invention in which the bend stiffener is released for conclusion of the pull-out operation.

FIG. 10 shows the system of the present invention in which the bend stiffener is released for conclusion of the pull-out operation. It is noted that with release of the lugs 30, the stiffener is free to be uncoupled from the bell mouth 2 if it is moving downward.

With all of the above, it is clear that the invention provides a system and a method for coupling a riser's bend stiffener 1 to a bell mouth 2 that enables automatic locking of the bend stiffener 1 to the bell mouth 2 at the moment at which the coupling is finalized without the need to perform a shallow dive to ensure that the coupling has been done correctly.

It is noted that performing a shallow dive may optionally be done in specific cases, or if so desired by the technicians responsible for the operation. Thus, this operation is not excluded from the process and becomes an optional stage.

Again referencing FIG. 4, a cross view of the locking mechanism 3 is shown, which allows the internal components of that element to be seen.

The locking mechanism 3, more broadly, is secured externally to the bell mouth 2 and it comprises a movable lug 30 positioned so that it is angled downward, in which the lug 30 accesses the inside of the bell mouth 2. In addition, the lug 30 is activated by an elastic element 34 adapted to exert pressure on the lug 30 towards the inside of the bell mouth 2.

As already described above, due to the angulation of the lug, it may be moved through the lower portion (A), comprising an elastomer cone, of the helmet 15 of the bend stiffener 1 during the pull-in process to be retracted, and after passage of the bend stiffener 1, the flexible elements 34 press it to return to the extended position, enabling locking of the bend stiffener 1/bell mouth 2 assembly.

Optionally, each lug 30 may be activated and aligned along a shaft 33 inside the locking mechanism 3, in which the shaft 33 is activated by the elastic elements 34, and it is adapted to transmit the forces generated by the elastic element 34 to the lug 30. In alternative configurations, the lug 30 and the shaft 33 are a single element, in which the shaft 33 is not as thick as the lug 30.

Optionally, the locking mechanism 3 also comprises a reaction block 35 in which the elastic element 34 is seated.

Again referencing FIG. 3, it is noted that the locking mechanism 3 optionally comprises an eccentric element 31 that multiplies the force for operating the handle 36, in order to facilitate movement of the lug 30 by the diver (when necessary). The eccentric element 31 is connected internally to the reaction block 35 by an assembly pin 32.

Therefore, when a diver activates the handle 36 in an operation to unlock the system, the reaction block 35 is activated, releasing the lug 30.

Therefore, this invention more broadly provides a coupling system between a bend stiffener 1 and a bell mouth 2 that comprises a plurality of locking mechanisms 3 in which each locking mechanism 3 is attached externally to the bell mouth 2, and it comprises a movable lug 30 positioned so that it is sloping downward, in which the lug 30 accesses the interior of the bell mouth 2 and it is activated by an elastic element 34 adapted to exert pressure on the lug 30 towards the inside of the bell mouth 2.

Countless variations to the scope of protection of this application are allowed, especially in light of the more general configuration described in the previous paragraph. Thus, reinforcing the fact that this invention is not limited to the specific configurations/implementations described above.

The invention claimed is:

1. A coupling system between a bend stiffener and a bell mouth, the coupling system comprising:

a plurality of locking mechanisms, wherein each of the locking mechanisms is attached externally to the bell mouth and positioned downward at a slant toward a longitudinal central axis of an interior of the bell mouth, and each of the locking mechanisms comprises a movable lug positioned so that the lug is angled downward, and the lug is activated by an elastic element adapted to exert pressure to move the lug downward at a slant towards the longitudinal central axis of the interior of the bell mouth.

2. A system in accordance with claim 1, wherein each lug is aligned along a shaft that is internal to the locking mechanism.

3. A system in accordance with claim 2, wherein the lug and the shaft are a single element, and wherein the thickness of the shaft is thinner than the lug.

4. A system in accordance with claim 1, wherein each of the locking mechanisms further comprises a reaction block in which the elastic element is seated.

5. A system in accordance with claim 1, wherein each of the locking mechanisms further comprises an eccentric force-multiplying element, wherein the eccentric force-multiplying element is connected internally to a reaction block by an assembly pin, and the eccentric force-multiplying element is adapted to multiply a force to activate the reaction block and to release the lug.

6. A system in accordance with of claim 1, wherein the bend stiffener comprises a helmet with a tubular shape, and an upper portion of the helmet comprises a domed shape.

7. A system in accordance with claim 6, wherein the helmet of the bend stiffener includes upper surface support elements for fusible cables.

8. A system in accordance with claim 1, wherein the bend stiffener comprises an intermediate region with a diameter smaller than an upper portion of the bend stiffener and a lower portion of the bend stiffener, and wherein the intermediate portion includes a conical transition section between the upper portion and the lower portion.

9. A system in accordance with claim 1, wherein the bend stiffener comprises a plurality of shearing elements, wherein each of the shearing elements is associated with a fusible cable, and wherein each of the shearing elements presses the respective fusible cable against an internal wall of the bell mouth when the bend stiffener is in its highest position inside the bell mouth.

10. A system in accordance with claim 1, wherein each of the locking mechanisms comprises:

a handle to move the lug to a retracted position or an extended position, and a clamp to lock the handle, preventing involuntary movement of the handle.

* * * * *